United States Patent [19]

Sirch et al.

[11] Patent Number: 4,489,645

[45] Date of Patent: Dec. 25, 1984

[54] AIR CONDITIONED ROOM AND METHOD FOR USING SAME

[75] Inventors: Edgar Sirch, Leverkusen; Jürgen Vicariesmann, Unna, both of Fed. Rep. of Germany

[73] Assignee: Glatt Maschinen - und Apparatebau AG, Pratteln, Switzerland

[21] Appl. No.: 441,524

[22] PCT Filed: Mar. 5, 1982

[86] PCT No.: PCT/CH82/00035

§ 371 Date: Nov. 5, 1982

§ 102(e) Date: Nov. 5, 1982

[87] PCT Pub. No.: WO82/03114

PCT Pub. Date: Sep. 16, 1982

[30] Foreign Application Priority Data

Mar. 7, 1981 [DE] Fed. Rep. of Germany ..... 3108678

[51] Int. Cl.[3] ..... F24F 9/00

[52] U.S. Cl. ..... 98/36; 98/34.6

[58] Field of Search ..... 98/33 A, 40 D, 36

[56] References Cited

U.S. PATENT DOCUMENTS

| | | | |
|---|---|---|---|
| 2,710,574 | 6/1955 | Runion . | |
| 3,115,819 | 12/1963 | Mahlmeister et al. | 98/33 A X |
| 3,229,609 | 1/1966 | Larson et al. . | |
| 3,301,162 | 1/1967 | Zumbiel | 98/36 |
| 3,385,036 | 5/1968 | Webb | 98/36 |
| 3,886,851 | 6/1975 | Berner | 98/36 |
| 3,960,196 | 6/1976 | Berner . | |
| 3,975,995 | 8/1976 | Shuler . | |

FOREIGN PATENT DOCUMENTS

| | | | |
|---|---|---|---|
| 2044543 | 3/1971 | Fed. Rep. of Germany . | |
| 2245265 | 3/1974 | Fed. Rep. of Germany . | |
| 2554610 | 6/1976 | Fed. Rep. of Germany | 98/36 |
| 2911462 | 9/1980 | Fed. Rep. of Germany . | |
| 2461205 | 1/1981 | France . | |

*Primary Examiner*—William E. Wayner
*Assistant Examiner*—John Sollecito
*Attorney, Agent, or Firm*—Fleit, Jacobson, Cohn & Price

[57] ABSTRACT

A clean-room chamber designed as a walkable clean-room cabin (1) has a front wall (7) with an entrance (13). A machine, e.g. a tablet press (41) is placed in the cabin. Above the entrance (13), a vertically adjustable air-supply member (17) for the formation of an air-curtain (71) is arranged. On the ceiling (11) of the cabin (1), in its front part, an air-supply member (29) with an outlet that is vertically adjustable and may be swung around a horizontal axis of rotation that is parallel to the front wall (7), has been mounted. With the aid of that outlet, a dust-displacement current is generated that is directed toward the machine (41) and but slightly turbulent. In the lower part of the rear wall (9), an exhaust device (43) has been mounted that is connected with the inputs of two blowers (27), the outputs of which are connected with the air-supply members (17, 29), while the air is filtered by means of high-performance mechanical filters (25) before being fed into the cabin. The aspirating surface (45) of the exhaust member (43) has been provided, in the air shadow of the machine (41) with a covering or recess that is impermeable to air. The cabin (1) makes it possible to keep the dust concentration of the air around the machine (41) low, at a low energy expenditure.

20 Claims, 5 Drawing Figures

Figure 4:
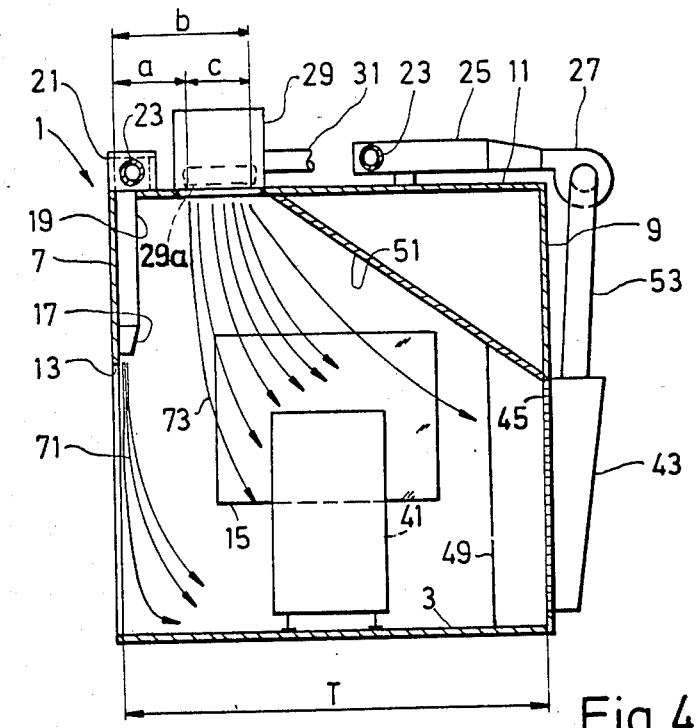

Fig.1
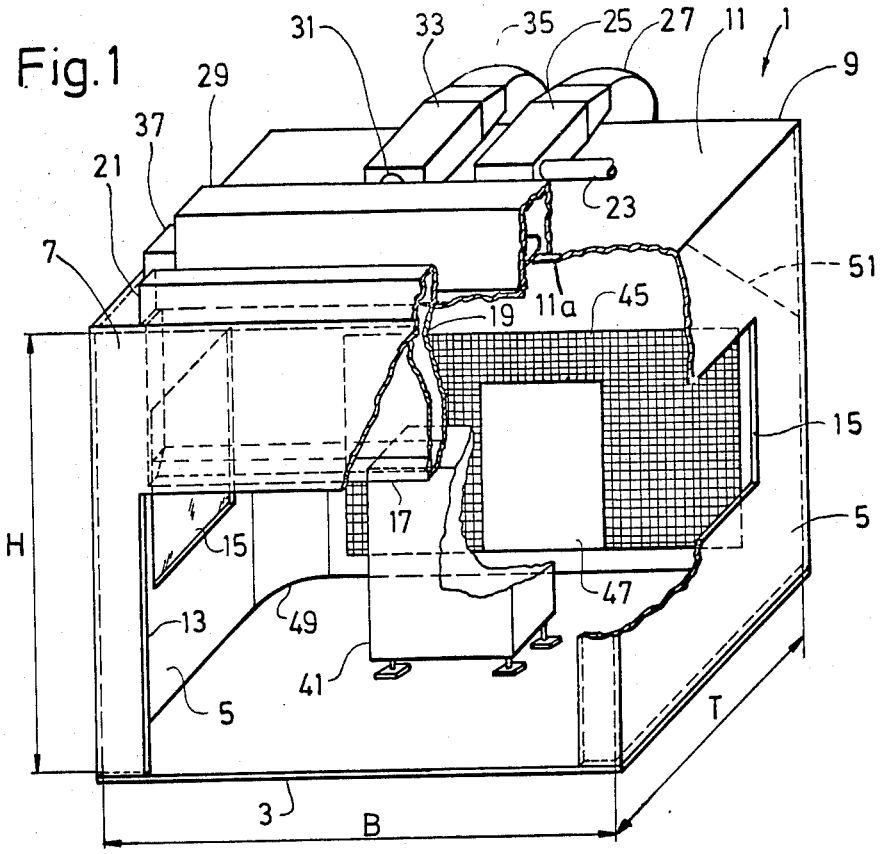
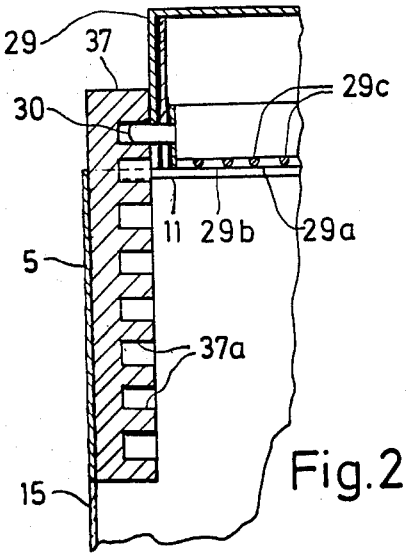
Fig.2
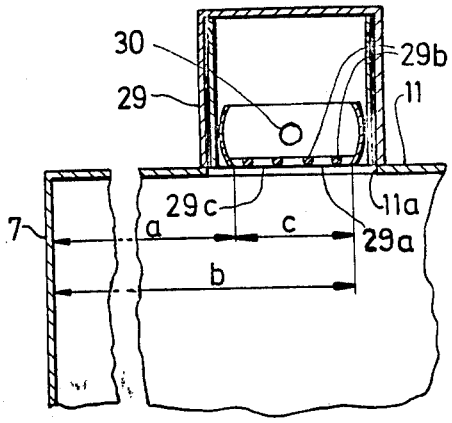
Fig.3

AIR CONDITIONED ROOM AND METHOD FOR USING SAME

The invention is concerned with a clean-room chamber having an interior room and an opening, in particular an entrance enabling a person to enter the interior room, and means for the generation of an air-flow.

There are a number of working procedures in various branches of industry that have to take place under clean-room conditions. Particularly high demands are made by the electronics, optical, and pharmaceutical industries. In the pharmaceutical industry, e.g., the making of pellets and other critical procedures of manufacture, filling, and packaging take place in clean-room compartments. Clean-room conditions for pharmaceutical products are, moreover, regulated by government regulations, of which, e.g., the GMP-Directives (Good Manufacturing in Practice) of the World Health Organisation may be mentioned. An especially critical problem is the processing of powdery products under clean-room conditions, because in this case, it is necessary not only to take the protection from contamination into consideration, but also to protect the operators of the machine from the effect of the dust, while they must not be hampered thereby in their work. That means that, in addition to the clean-room requirements, aspects of ergonomics and of industrial safethy must be taken into account. This set of problems occurs, e.g. when a tabletting machine is set up in a clean-room compartment. Clean-room compartments are known in which the ventilating system comprises an entire wall of the room or a ceiling and generates, over the entire room a horizontal or vertical, more or less laminar displacement flow for the removal of the dust. This solution requires an expensive design and, in addition, requires much energy, due to the large air volumes that are revolved.

That is where the invention comes in. The problem was the creation of a clean-room chamber that is more favorable, inasmuch as the capital expenditure and the energy requirements are concerned, and that, nevertheless, the demands made upon it as to protection from contamination, as to ergonomics and industrial safety satisfies in their entirety.

This problem is solved by a clean-room chamber of the type indicated at the outset: the chamber in accordance with the invention is characterized by the fact that an air-supply member is present, with an outlet turned toward the interior room and having an adjustable position. Advantageous developments of the chamber are evident from claims 2 to 8.

In addition, the invention is concerned with a method of operating the cabin, by generating—in its interior space—an air flow, preferably a dust-displacement flow with little turbulence. In accordance with the invention, the method is characterized by the fact that, in the upper region of the chamber, filtered air is fed into it. An advantageous development of the method is evident from claim 10.

By the use of the clean-room chamber in accordance with the invention, and of its developments, the following advantages may be achieved:

The clean-room chamber which is developed, in particular, as a cabin with an interior room that is walkable by a person, makes it possible to work, ergonomically and in accordance with government regulations, with powdery pharmaceutical products, under improved economic conditions.

The design of the clean-room chamber makes a targeted dust exhaustion and elimination possible, so that conditions of environmental protection can be complied with more thoroughly. In addition, the operational parameters can be modified easily according to the application in each case.

Expedient operation is ensured by the ease of operation and by the clear arrangement of the chamber. Lastly, the chamber can be cleaned easily and without any great effort.

All the operational parameters that are relevant to the functioning of the clean-room chamber can be comprehended and documented without any great expense.

In the following, the invention will be explained on the basis of an example of the embodiment of a clean-room cabin as shown in the drawing. In the drawing, there are shown as FIG. 1: a somewhat schematic oblique view of a partially opened-up clean-room cabin, FIG. 2: a vertical longitudinal section through the air-supply member which is vertically adjustable and horizontally swingable, on a larger scale, FIG. 3: a cross-section through the air-supply member as seen in FIG. 2.

Figure 5:
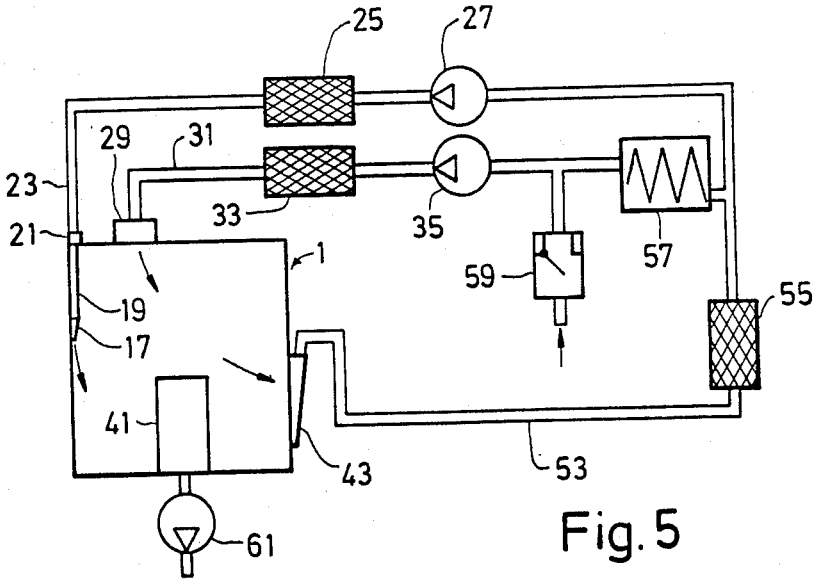

FIG. 4: a schematic vertical section through the cabin, with the sectional plane passing through the part of the cabin that is closer to the viewer, and with certain members not having been cut, and FIG. 5: a circuit diagram of the components for the generation of the air flow.

The clean-room cabin 1 as shown in FIGS. 1 and 3 has the general form of a parallelepiped-and presents a bottom 3, two lateral walls 5, a front wall 7, a back wall 9, and a cover 11; all walls are essentially vertical and plane. The two lateral walls 5 have been provided with one window, of glass or a similar material, each, and the front wall has an opening, without a door, that forms an entrance 13. The interior room bounded by the cabin has the width B when measured horizontally and parallel to the front wall 7, the depth T when measured horizontally and at a right angle to the front wall, and the height H when measured vertically. These internal measurements, or the corresponding external measurements may amount, in the sequence to be indicated, e.g. approximately 4.5 m, 3.8 and 3.7 m. The upper edge of the entrance is located at a distance from the interior surface of the ceiling 11 that amounts to, at least, 20% and, e.g., 30 to 50% of the height H, depending on the height of the cabin. Inside the cabin, above the entrance 13 and near its upper edge, an air-supply member 17 has been mounted, in such a way that it may be adjusted up and down and fixed at various heights. The underside of the air-supply member 17 presents a nozzle slot that extends, at least approximatively, over the entire width of the entrance 13, or even beyond it, on both sides. Besides, the nozzle slit extends over, at least or approximately, 50%, preferably over 70%, and e.g. over some 80% of the width B. The supply member 17 is connected, by means of a telescopic conduit 19 with a distributor channel 21 that is fastened to the ceiling 11, and that, in turn, is connected with the output of a blower 27 by way of a conduit 23 and a filter 25. Near the front wall, the ceiling 11 is connected with a slit that runs parallel to the front wall and has been designated by 11*a*. Close to that slit, an air-supply member 29 has been mounted on the ceiling 11; said member is shown separately, but in a somewhat simplified and schematic manner, in FIGS. 2 and 3. The underside of the supply member 29 presents an air outlet 29*a* that, in exactly the same way as the nozzle slit of the supply member 17, extends at least over the width of the entrance 13 as well as at least over 50%, preferably over at least 70%, an e.g. over 80% of the width B. The longitudinal edge—which is closer to the front wall 7—of the outlet 29*a* is located at a distance a from the inner surface of the front wall 7. The longitudinal edge of the outlet that is farther away from the front wall 7 is located at a distance b from the inner surface of the front wall 7. The distance a amounts to, at least, 5% and, e.g., 10 to 25% of the depth T. The distance b amounts to no more than 60%, preferably to no more than 50% suitably no more than 40%, and, e.g. at least 25% of the depth T. The distance from the middle of the outlet 29*a* from the front wall 7 may, e.g., amount to about one fourth of the depth T. The dimensions c—as measured horizontally and perpendicularly to the front wall 7—of the outlet 29*a* amounts to no more than 50%, preferably to no more than 30%, and e.g. to 10 to 25% of the depth T. The height of the outlet 29*a* may be adjusted and fixed at various heights. The outlet may be lowered from a position in which it is located more less at the height of the ceiling 11, or even above it, into a position in which it will be inside the cabin. But, advantageously the outlet 29*a* is located in any possible position above the standing height of a person and above the entrance 13, while its height above the floor 3 amounts to, at least, 1.9 m and preferably to, at least, 2.2 m. In addition, the outlet 29*a* may be swung around a horizontal axis of rotation which runs parallel to the front wall 7, and may be fixed in various swivel positions. In order to render the adjustment of the height and the swingability possible, the supply member 29 may—as has been shown in a simplified manner in FIGS. 2 and 3, developed in the form of a telescopic extension consisting of several parts and presenting a casing that is mounted on the upper side of the ceiling 11 in a rigid and detachable manner, said casing being open at the bottom and having an interior room that is sealed hermetically against the environment. On both lateral walls 5, a stationary holder 37, i.e. a vertical rail with holes 37*a* has been mounted. The outlet 29*a* may be pulled downward out of the casing into the interior space of the cabin, held by means of two swivel pegs 30 selectively swingable at various heights in a pair of holes 37*a*, and fixed by clamping means or similar devices in various positions of horizontal swing. The outlet 29*a* is designed in the form of a lattice or grate and has ledges 29*b* that run horizontal and parallel to the front wall 7, and ledges 29*c* intersecting them at right angles, while the ledges 29*b*, 29*c* atr defined cross-sectionally, on their undersides, by a convex surface. The supply member 29 is connected with the output of a blower 35 by way of a lead 31 which, if necessary, may be designed so as to be movable, and of a filter 35.

In the inside room of the cabin 1, a machine 41 is mounted that stands more or less in the center of the cabin on the floor 3 and is separated from all the cabin walls 5, 7, 9 and from the cabin ceiling 11 by free intervening spaces. At the lower part of the rear wall 9, a box-type exhaust member 43 is mounted that has a vertical, perforated suction side 45 which faces the interior of the cabin and extends, e.g., over approximately, or at least, half the width and half the height of the rear wall 9. Advantageously, the suction side 45 projects, on top and on both sides, beyond the elevation—projected on it at a rigt angle—of the machine 41. The suction side 45 has a cover or plate (47) that is impermeable to air and extends approximately over the area of the suction side 45 that is covered by the elevational of the machine.

The two vertical edges by which the rear wall 9 abuts the lateral walls 5, are covered by vertical curved plates on the inner side of the cabin in the inner part; these plates form on guide-surface ("Leitflache") 49 each. the upper rear corners of the cabin that are formed by the rear wall 9, the ceiling 11, and one lateral wall 5 each, as well as, preferably, the entire edge that connects those corners and is formed by the rear wall and the ceiling, are covered, on the inner side of the cabin, by at least one plate which forms an inclined guide-surface 51. That guide-surface originates in the ceiling 11, near the edge—facing the rear wall 9—of the slit 11*a* and extends downward approximately to the lower edge of the suction side 45. Advantageously, the guide-surfaces 49 and 51 border on one another and may be connected by rounded transitional sections.

The lamps that are necessary for the lighting of the machine and of the working space surrounding it may—at least in part—be mounted on the plate constituting the guide-surface 51.

The exhaust member 43 is connected with the inputs of input-sides of the two blowers 27 and 35 by way of a suction-pit-like connection 53 which has been designated by 53 in FIG. 4. As may be seen from the schematic drawing of FIG. 5, an auxiliary filter 55 has been interpolated in the connection 53. Behind that filter, the connection 53 is branched onto the two blowers 27, 35, while—in addition—a cool 57 is lined up in front of the input of the blower 35. Moreover, a fresh-air intake tube with an adjusting member 59 consisting, e.g., of a so-called air-flap ("Luftklappe") is connected with the input of the blower 35.

The two filters 25 and 33 have been developed as high-performance mechanical filters that are also called, by way of abbreviation, HOSCH-filters. During a test with dioctyl phthalate (DOP)-smoke with a particle size of 013 micrometer, these filters yield a percentage of separation of, at least, 99.97% or even of, at least. 99.99%. Filters of this type are supplied, e.g., by the Cambridge Filter Corporation under the model designation "Absolute." The auxiliary filter 55 may be a conventional dust filter having a lower percentage of separation.

The machine 41 is used to prepare, process, fill, or test pharmaceutical products, and may, e.g., be a preforming press. The machine 41 has a casing that separates it, at least to some extent, from the remaining inner space of the cabin. In addition, the machine 41 may be equipped with its own air-exhaust device that comprises a suction fan designated in FIG. 5 by 61 and is led off with the air into the environment by way of a separate lead.

The delivery efficiency of the two blowers 27 and 35 and, possibly, also the one of the blower 61, is adjutable continuously; the range of adjustment, e.g. based on an average performance, may amount to ±30%.

When the clean-air cabin is used, the two blowers 27 and 55 supply air to the air-supply members 17 and 29 by way of the high-performance mechanical filter 25 and 33; this air is filtered by te two filters, so as to be particle-free and practically sterile. The air-supply member 17 will the generate an air curtain designated in FIG. 4 by 71, at the input 17. That curtain is constituted by an air flow that is generally directed downward and, e.g., largely laminar, while at least the larger part of the air-flow will then be redirected, slightly above the bottom 3, into the interior of the cabin and flow toward the suction side 45. The air-supply member 29 generates, by means of its outlet 29*a*, which is turned toward the interior of the cabin and opens into it while presenting openings ditributed within a plane, a flow 73 that displaces the dust and is directed downward against the machine, in dependence on the swivel position of the outlet; the flow 73 will then also be directed toward the suction side 45. The supply member 29 distribute the air, in such a way that the displacement flow 73 is essentially laminar or, at least, almost free of turbulence. The positions of the two supply members 17 and 29 as well as the amounts of the delivered air are coordinated with the design of the machine 41, in such a way that a flow with the least possible turbulence will result, particularly within the region of the machine 41; at least, the greater part of that flow is formed by air from the supply member 29. The recess or clearance 47 extends, more or less, over the "air shadow" of the machine 41 and ensures that the flow remains, at least approximately free of turbulence, even between the machine and the exhaust member 43. The guide-surfaces 49 and 51 guide the air currents to the sucion surface 45 an also contribute to keep the displacement flow in the interior of the cabin turbuleance-poor, and prevent, by the way, the formation of dead, i.e. non-ventilated areas of the inner space of the cabin.

The flow forming the air-curtain 71 and the dust-displacement flow 73 are, at least inasmuch as their initial sections that begin at the air-supply members 17 and 29, separated to some extent. In those regions in which the two air currents run next to one another, more or less parallel, there may exist a velocity gradient between them in the boundary layer.

Advantageously, the air velocity of the displacement flow 73 is, in general and in particular when it leaves the outlet 29*a*, considerably lower than the air velocity of the air curtain 71 at the inlet 13. The delivery efficiency of the blower 27, and in particular the one of the blower 35, is fixed in such a way that the air velocity of the displacement flow in the region near the machine 41 amounts to, e.g., 0.2 m/s.

For the formation of the air curtain 71, e.g. an air volume of, e.g. 1600 $m^3/h$ passes through the supply member 17. Out of the supply member 29, e.g. an air volume of some 7000 $m^3/h$ issues for the formation of the displacement flow. E.g., an air volume up to a maximum of 1000 $m^3/h$ is exhausted by the blower 61 from the cabin into the environment. That means that the ventilation of the cabin largely takes place by means of a recirculating process, i.e. by circulation of the same air. The blower 35 is capable of drawing in fresh air by way of the adjusting member 59, in order to replace the air that has been removed from circulation by the blower 61.

The ventilation of the cabin may take place, in such a way that the pressure in its interior—depending on the requirements—is equal to the air pressure in the surroundings, or smaller or greater. The heat that is transmitted to the air during the operation of the machine 41, may be carried off through the cooler 57. Besides, the fresh air drawn in by way of the adjusting member 59 has room temperature and also results in a cooling effect. If this is required, the temperature inside the cabin may be kept constant within a predetermined range, by means of appropriate dimensions and, possibly, control or adjustment of the cooler 57. In addition, there is the possibility of re-use of the heat carried off by the cooler 57.

The machine 41 which may be a tablet-preforming press, generates dust during its operation and, for that reason, increases the dust concentration of the air in the surroundings of the machine that constitute the working place for the operating personnel. The displacement flow 73 which passes by the working place, removes that dust and lowers the dust concentration, e.g., to one hundredth part or to an even smaller amount of the dust concentration that is the result of operation in a conventionally ventilated room. The dust carried off by the air will then be eliminated in the filters 55, 25, 33.

In the ventilating method as described here, filtered air is fed into the inside of the cabin exclusively by the two air supply members 17 and 29, while the volume of air fed in by the supply member 29 is larger than the volume of air fed in by the supply member 17. It should be pointed out, however, that the machine mounted in the cabin could, under certain circumstances, have its own circulation with an air intake, but in that case, this "intra-machine" air circulation is designed, in such a way that, at most, a small part—when compared to the air volume of the dust-displacement current flowing through the cabin—of the air that is supplied to the machine directly emerges into the cabin. Consequently, filtered air is—at least generally—supplied to the interior of the cabin only at places the greatest distance from the front wall 7 is given by the distance b. Depending on the cabin pressure, unfiltered ambient air may enter the cabin through the inlet 13, but this share of ambient air is but small by comparison with the volumes of air delivered by the supply members 17 and 29. Consequently, the ventilation method makes it possible to keep the dust concentration in the inner room of the cabin very low, at a small expenditure of energy. In addition, a dust exchange with the surroundings of the cabin can be prevented almost completely. The air-supply members 17 and 24 can be designed easily, in such a way that they may be cleaned easily and, if need be, disassembled from the cabin for cleaning purposes. The supply member 17, its telescopic air-uptake duct 19, the distributor channel 21, and the supply member 23 may be mounted, e.g., on the ceiling 11 only, in such a way that they are accessible from the upper side, i.e. from the outside of the preferably walkable ceiling, and that they may be disassembled. Moreover, the other members 27, 31, 33, 35, 43, 53, 55, 57, 59, 61 of the ventilating system are—at least, to a large extent—located outside the cabin and are, at least in part, fastened to it, as well as accessible and cleanable from the outside. When the machine is exchanged, or when different machines are placed in similar cabins, the air supply members 17 and 29 and the flow volumes delivered by the blowers 27,35 may, in each case, adjusted, in such a way that optimal flow conditions will result. If the height of the outlet 29*a* has to be changed, the swivel pegs 30 will have to be inserted into other holes 37*a* of the holders 37. During that operation, the swivel pegs 30 may be pulled out of the holes 37*a* temporarily, e.g. by manual acuation of an actuating member, against the force of the springs acting on them. Besides, the cabin may advantageously be disassembled and assembled easily and rapidly, so that its location may be changed rapidly when needed.

The clean-room cabin and its ventilating system may be modified in various respects.

E.g., it is possible to do without equipping the cabin with its own bottom, so that their walls will then stand directly on the floor of the room, in which it is placed. In addition, the cabin may be equipped with wheels so as to facilitate any change of its location.

The guide surface 51 extends—as we have mentioned above—advantageously over the entire length of the rear wall 9 and of the ceiling 11, and is inclined and plane, but it could also be inclined and curved in its vertical section, so that it will adjoin closely—more or less uniformly—the rear wall and the ceiling. Moreover, it would be possible to provide, in lieu of a plate extending along the edge between rear wall and ceiling or in addition to it, triangular plates that lie with one edge each against a lateral wall 5, the rear wall 9, and the ceiling 11, and form one guide surface each that is inclined in relation to the rear wall as well as in relation to a lateral wall, that is flat or curved, and that covers one of the upper rear cabin corners. It would be possible also, instead of designing the walls and the ceiling of the cabin so as to be largely flat, and of covering the lateral and upper edges and corners on the rear side of the square-shaped cabin, further to develop the walls and the ceilings of the cabin, in such a way that they form transitional surfaces corresponding to the guide surfaces 49, 51.

The high-performance mechanical filter 33 could also be integrated directly into the supply member 29 and, together with it, form one single component. In this case, the outlet **29*a*** could be constituted, e.g., directly by the outlet of the filter and, once more, adjustable as to its height and swingable.

For the height adjustment of the supply-member outlet **29*a*, one might, instead of the holders constituted by perforated guide rails 37, provide holders in which a vertically adjustable swivel bearing may be fixed by means of screws or of magnets at different heights. In addition, the swivel bearings of the outlet may be designed so as to be continuously height-adjustable instead of being adjustable step-by-step. Instead of mounting the casing of the supply member 29 rigidly on the ceiling 11 and of designing only the outlet 29*a*, in such a way that it is height-adjustable and swingable, it would be possible also to mount the entire air-supply member 29 on the ceiling of the cabin, so that it is height-adjustable and swingable, viz. when the supply organ 29 and the filter 33** are spatially separated as well as when the supply member and the filter are combined into one.

Furthermore, one could provide, instead of the two blowers 27, 35, one single blower only and use it, in this case, to feed both air-supply members 17, 29. It would be possible, in this case, either to feed—as in the example of the embodiment shown in the drawing—each of the two supply members 27, 29 with air by way of a separate high-performance mechanical filter, or, also, to provide one single filter only and to branch off the air onto the two supply members only behind it. Moreover, it would then be possible to interpose an adjusting member for the control of the air supply, e.g. an air flap, in front of at least one of the two air supply members.

The dimensions of the cabin may vary within wide limits. The outside height inclusive of the ceiling superstructures may, e.g., amount to 4 m or also to 3.5 m or even less, so that the cabin may be housed in a room having a height of 3.5 m.

In addition, in lieu of a cabin with an interior room that is walkable by one person, solely a chamber constituting a clean room-workbench-box the bottom of which is located at the level of a work bench and also is used as such, and the walls of which have, in lieu of an entrance, an opening through which a person can reach with his hands into the interior of the chamber, for the performance of operations.

We claim:

1. A clean room chamber comprising:

a. a housing with a rear wall, two side walls, a front wall defining an entrance opening opposite said rear wall, and a ceiling;

b. air curtain means defining an air outlet for providing a downwardly directed air curtain at said entrance opening;

c. air supply means positioned above said entrance opening between said front wall and said rear wall and nearer to the front wall and including an air outlet opening into the interior of the chamber for supplying air to the interior of said chamber;

d. exhaust means forming a suction surface extending over at least a part of said rear wall;

e. pump means connected with and for supplying air to said air curtain means and to said air supplying means;

f. filter means positioned upstream of said outlet of said air curtain means and upstream of said outlet of said air supply means;

g. said air outlet of said air supply means being pivotable in relation to a horizontal axis substantially parallel to said front wall of said housing so that said air outlet can be positioned for producing a substantially turbulence-free, dust displacing air current directed downwardly and rearwardly toward said suction surface.

2. The chamber of claim 1 wherein said air outlet of said air supply means is vertically adjustable relative to said entrance opening.

3. The chamber of claim 1 wherein said air outlet of said air supply means is subdivided into a plurality of openings.

4. The chamber of claim 1 wherein said suction surface includes obstruction means between opposite edges thereof to obstruct the flow therethrough in a portion of the suction surface.

5. The chamber of claim 1 wherein said rear wall and said ceiling are connected by an inclined flow guide surface above said suction surface.

6. The chamber of claim 1 wherein said air outlet of said air curtain means is vertically adjustable.

7. The chamber of claim 1 including a particulate material processing machine and air exhaust means associated with said machine.

8. The chamber of claim 1 wherein the distance between said front wall and a longitudinal edge of said outlet opening of said air supply means, said longitudinal edge being furthest from said front wall, is no closer to said rear wall than 60% of the maximum depth of the interior of the chamber measured horizontally from said front wall to said rear wall.

9. The chamber of claim 1 wherein said air outlet of said air supply means extends laterally for a distance of at least 50% of the distance between said side walls.

10. The chamber of claim 3 wherein said air outlet of said air supply means is subdivided by intersecting ledges.

11. The chamber of claim 4 wherein said obstruction means are dimensioned for obstructing approximately that portion of the suction surface that is covered by a working device to be positioned in the chamber and lying in the air current path, the suction surface having unobstructed portions above and on both sides of said obstruction means.

12. The chamber of claim 1, wherein said filter means comprises a high performance filter for suspended particles positioned upstream of said outlet of said air supply means.

13. The chamber of claim 12, wherein said high performance filter for suspended particles is incorporated in said air supply means and is mounted to said ceiling.

14. The chamber of claim 1, wherein said suction surface extends over a part of the height of the clean room chamber interior and is spaced from said ceiling.

15. The chamber of claim 1, wherein the distance between said front wall and a longitudinal edge of said outlet opening of said air supply means, said longitudinal edge being furthest from said front wall, is no closer to said rear wall than 50% of the maximum depth of the interior of the chamber measured horizontally from said front wall to said rear wall.

16. The chamber of claim 1, wherein said air outlet of said air supply means is spaced horizontally from said front wall a distance at least 5% of the maximum depth of the interior of the chamber measured in the same direction.

17. The chamber of claim 1, wherein said air outlet of said air supply means is spaced horizontally from said front wall a distance at least 10% of the maximum depth of the interior of the chamber measured in the same direction.

18. The chamber of claim 1, wherein the air outlet defined by said air curtain means is spaced downwardly and forwardly of said air outlet of said air supply means.

19. The chamber of claim 1, wherein said filter means includes a high performance filter for suspended particles upstream of said air outlet defined by said air curtain means.

20. The chamber of claim 1, further comprising connecting means connecting said exhaust means with the inlet of said pump means.

* * * * *